United States Patent [19]

Bosch

[11] 4,161,372

[45] Jul. 17, 1979

[54] INTERNAL-GEAR FLUID-DISPLACEMENT MACHINE WITH MOVABLE SEPARATING BODY

[75] Inventor: Paul Bosch, Ludwigsburg, Fed. Rep. of Germany

[73] Assignee: Robert Bosch GmbH, Stuttgart, Fed. Rep. of Germany

[21] Appl. No.: 846,525

[22] Filed: Oct. 28, 1977

[30] Foreign Application Priority Data

Nov. 6, 1976 [DE] Fed. Rep. of Germany ..... 2650908

[51] Int. Cl.[2] ..... F01C 1/10; F01C 19/00; F03C 3/00; F04C 1/06

[52] U.S. Cl. ..... 418/126; 418/131; 418/170

[58] Field of Search ..... 418/126–129, 418/131, 132, 169, 170

[56] References Cited

U.S. PATENT DOCUMENTS

| | | | |
|---|---|---|---|
| 2,544,144 | 3/1951 | Ellis | 418/170 |
| 3,315,609 | 4/1967 | Eckerle | 418/169 |
| 3,586,465 | 6/1971 | Eltze | 418/126 |
| 3,966,367 | 6/1976 | Erickson | 418/126 |

FOREIGN PATENT DOCUMENTS

| | | | |
|---|---|---|---|
| 1905146 | 10/1970 | Fed. Rep. of Germany | 418/126 |

*Primary Examiner*—John J. Vrablik
*Attorney, Agent, or Firm*—Michael J. Striker

[57] ABSTRACT

An internal-gear fluid-displacement machine, such as a fluid-displacing pump or a fluid-displaced motor includes an internal gear and a spur gear which meshes with the internal gear at a meshing region. A separating body fills a separating region between the gears which narrows toward the meshing region and separates the same from the remainder of the interspace between the gears. An actuating lever is mounted on the housing for pivoting and extends through the interspace, and a piston subjected to the pressure prevailing at the meshing region abuts against a free end of the actuating lever, pressing the same into abutment with that end of the separating body which faces into the remainder of the interspace. A strap connects the separating body to the actuating lever. The axial sides of the separating body have depressions therein which are bounded by narrow sealing projections which converge toward the meshing region.

13 Claims, 6 Drawing Figures

INTERNAL-GEAR FLUID-DISPLACEMENT MACHINE WITH MOVABLE SEPARATING BODY

BACKGROUND OF THE INVENTION

The present invention relates to a fluid-displacement machine, such as a pump or motor, in general, and to an internal-gear fluid-displacement machine in particular.

There has been already proposed an internal-gear type fluid-displacement machine in which a separating body is located in the interspace between the internal gear and the spur gear which is located within the internal gear and meshes therewith. In this context, it is to be mentioned that the separating body is arranged between and separates the high-pressure and the low-pressure zones of the machine so that the separating body must be so mounted in the narrowing region of the interspace as to be in a steady contact with the crests of the teeth of the two gears, irrespective of manufacturing tolerances, wear, thermally or pressure-caused deformations and other deviations from the desired shapes of the various components of the machine.

In view of the above-mentioned requirement, it has been already proposed to mount the separating body for displacement. Under these circumstances, however, it is necessary to exert a force on the separating body to keep the same in steady abutment or contact with the crests of the teeth of the two gears. Thus, it has been already proposed to articulately mount the separating body in the internal chamber of the housing of the machine. Then, a piston exerts a radial force on the outer surface of the internal gear, thus passing the internal gear against the radially outer contact surface of the separating body and also against the flanks of the teeth of the spur gear. The separating body rests radially inwardly on the crests of the teeth of the spur gear and abuts, in the circumferential direction, against a support bolt. The support bolt is supported either by the axially arranged sealing plates for the gears, or by the housing of the machine. This construction is relatively expensive and requires a considerable amount of available space which makes the machine unnecessarily huge.

SUMMARY OF THE INVENTION

Accordingly, it is a general object of the present invention to avoid the disadvantages of the prior art.

More particularly, it is an object of the present invention to so construct an internal-gear fluid-displacement machine as not to be possessed of the above-mentioned drawbacks.

Yet another object of the present invention is to propose a fluid-displacement device of the type here under consideration which is simple in construction, easy to manufacture and assemble, and reliable nevertheless.

A concomitant object of the present invention is to so design the machine as to improve the pressure conditions prevailing therein.

Still another object of the present invention is to develop a fluid-displacement machine in which leakage losses are kept to a minimum even after the components of the machine have been considerably worn out.

An additional object of the present invention is to so construct the fluid-displacement machine that the gears thereof can be manufactured with a lesser degree of precision than heretofore required, without impairing the operation of the machine.

A yet further object of the present invention is to so design the machine as to achieve a uniform and pulsation-free increase of the pressure of the fluid in the tooth interstices of the gears.

In pursuance of these objects and others which will become apparent hereafter, one feature of the present invention resides, briefly stated, in an internal-gear fluid-displacement machine comprising, in combination, a housing having an internal chamber; an internal gear in the chamber; a spur gear located in the chamber and meshing with the internal gear at a meshing region which constitutes a high-pressure zone of the machine during operation, the gears bounding with each other an interspace which constitutes a low-pressure zone of the machine, and a separating region which narrows from the interspace toward the meshing region; an elongated separating body which fills the separating region thus separating the low-pressure and high-pressure zones from one another; an actuating element connected to the separating body for joint displacement substantially longitudinally of the latter; and means for subjecting the actuating element to a force which acts substantially longitudinally of the separating body and has a magnitude which depends on the pressure of a fluid present at the high-pressure zone. Advantageously, the machine of the present invention further comprises sealing plates which are arranged at and contact the axial faces of the gears, the sealing plates also guiding the separating body for the above-mentioned displacement thereof. Preferably, the actuating element is a lever having one end mounted on the housing for pivoting, and a free end. Then, the subjecting means includes a piston mounted in a bore of the housing and having one end face to which fluid from the high-pressure zone is admitted to act on the piston and press the other end face of the piston against the free end of the lever. In addition thereto, the subjecting means advantageously includes a spring which acts on the piston opposite to the action of the fluid thereon.

According to a further advantageous aspect of the present invention, the fluid-displacement machine further comprises means for determining play between the separating body and the gears, including means for limiting the extent of displacement of the piston. Such limiting means may advantageously include an abutment which is rigid with the housing. The abutment may be a setting screw which extends to a predetermined extent into the bore and has an abutment surface against which the piston abuts at one end of its stroke. On the other hand, the housing may include a cylinder body which is detachably mounted in an opening of the housing and has the above-mentioned bore for the piston, the cylinder body having an abutment surface which constitutes the above-mentioned abutment and against which the lever abuts at one extreme of its displacement. Advantageously, the piston has a spherical configuration at least at a region thereof which contacts the lever.

A currently preferred embodiment of the present invention has the above-mentioned lever extending into the interspace and a contact surface of the separating body which faces the interspace abutting the lever. Advantageously, the lever is connected to the separating body by a strap.

A particularly advantageous embodiment of the present invention is obtained when the separating body has a narrow sealing projection at each of its axial sides, which sealing projection bounds a depression which substantially conforms in shape to the respective axial side. Then, it is advantageous for the sealing projection to converge toward the meshing region. By properly selecting the width of the sealing projection, the pressure increase in the interstices of the gear teeth of the spur gear and of the internal gear can be so controlled that the pressure increases substantially linearly over the segment delimited by the separating body.

Advantageously, the spur gear is mounted in two axial bores of the housing, and the internal gear is supported in a bearing bowl located in the interior of the housing. This type of support of the two gears results in a very simple, inexpensive but reliable construction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
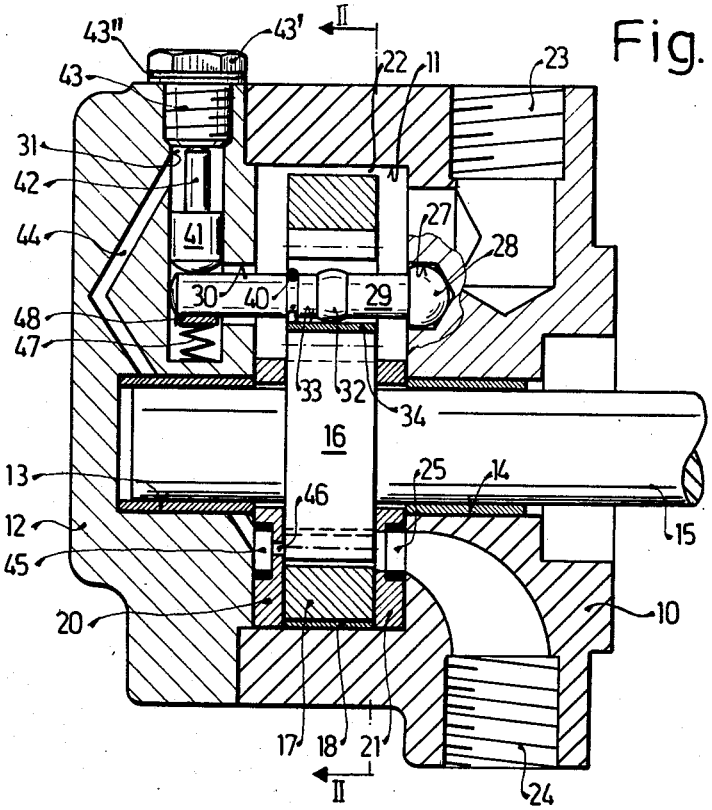
FIG. 1 is a longitudinal sectional view of an internal-gear fluid-displacement machine of the present invention taken on line I—I of FIG. 2.

Referring now to the drawing in detail, and first to FIG. 1 thereof, it may be seen therein that an internal-gear fluid-displacement machine of the present invention includes a housing 10 which has a central cylindrical chamber 11 which is closed by a lid 12. A shaft 15 of a spur gear 16 which is accommodated in the chamber 11 is mounted on the housing 10 in coaxial bores 13 and 14. The spur gear 16 meshes with an internal gear 17 which has an annulus of internal teeth, the internal gear 17 being supported on the housing 10 by a bearing bowl 18 arranged in the chamber 11 of the housing 10.

The axial width of both the spur gear 16 and the internal gear 17 is smaller than the axial width of the chamber 11 of the housing 10. In this manner, there is left sufficient room for accommodation of two sealing plates 20 and 21 therein, the sealing plates 20 and 21 laterally abutting the gears 16 and 17 and extending from the lower regions of the gears 16 and 17 up to somewhat above the axis of the shaft 15. As a result of this arrangement of the sealing plates 20 and 21, the upper portions of the internal gear 17 and of the spur gear 16 are freely received in the chamber 11 which constitutes a suction space 22 at such free region. This suction space 22 is connected with a non-illustrated conventional low-pressure reservoir via a channel 23 of the housing 10.

A channel 24 of the housing 10 communicates with the region of meshing of the gears 16 and 17 with one another, the channel 24 communicating with the region at which the teeth of the gears 17 and 16 mesh with one another through an orifice 25 in the sealing plate 21. At the other end thereof, the channel 24 of the housing 10 communicates with a non-illustrated conventional high-pressure conduit to a user or the like.

A cylindrical or spherical recess 27 is formed in the housing 10 upwardly of the shaft 15, in which there is supported a spherical head 28 of a bolt-shaped lever 29. The lever 29 passes through the interspace between the internal gear 17 and the spur gear 16 and the free end portion thereof extends through a bore 30 in the lid 12 into a blind bore 31 also provided in the lid 12. The bolt-shaped lever 29 is offset with respect to the axis of the two gears 16 and 17 toward that side at which the gears 16 and 17 come into contact. The direction of rotation of the gears 16 and 17 is indicated in FIG. 2 by an arrow A.

The bolt-shaped lever 29 has a barrel-shaped portion 32 at its region which is located in the interspace between the gears 16 and 17, the barrel-shaped portion 32 pressing against an end face 33 of a sickle-shaped separating body 34. The separating body 34 is fittingly received in the separating region which is delimited, on the one hand, by the bolt-shaped lever 29 and, on the other hand, by the crests of the teeth of the spur gear 16 and those of the internal gear 17, respectively. The sickle-shaped separating body 34 extends up to the region of merger of the gears 16 and 17. The width of the separating body 34 corresponds to the width of the spur gear 16 and that of the internal gear 17. The separating body 34 is accommodated, over the greater part of its length, between the sealing plates 20 and 21, being guided thereby.

Figure 2:
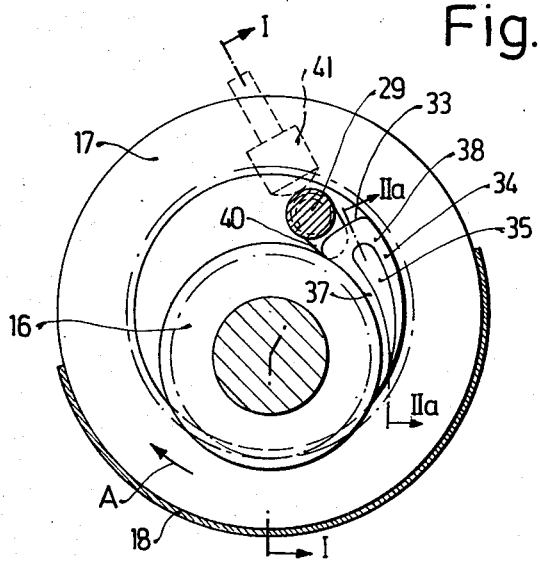
FIG. 2 is a cross-sectional view taken on line II—II of FIG. 1.
Figure 2A:
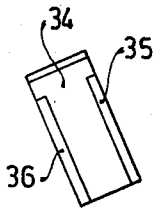
FIG. 2*a* is a sectional view of a detail of FIG. 2, taken on line IIa—IIa.

As will become apparent from the comparison of FIGS. 2 and 2*a*, a flat depression 35 or 36 is formed at the two axial sides of the separating body 34, the shape of the depression 35 or 36 essentially corresponding to that of the axial side of the separating body 34 in which the depression 35 or 36 is formed, so that, in the radially outward direction, only relatively narrow sealing projections 37 and 38 remain which are in contact with the sealing plates 20 and 21. The width of the sealing projections 37 and 38 decreases, in accordance with a predetermined formula, in the direction of rotation of the gears 16 and 17.

A strap 40 is mounted on the bolt-shaped lever 29, the strap 40 penetrating into or being otherwise connected to the separating body 34, thus connecting the same to the bolt-shaped lever 29.

As already mentioned before, the bolt-shaped lever 29 extends into a blind bore 31 provided in the lid 12, the bore 31 being located along a plane which is normal to the axis of the shaft 15 of the spur gear 16. A piston 41 is accommodated in the bore 31 for sliding therein in sealing contact with the surface bounding the bore 31. The piston 41 has a portion 42 of a reduced diameter which, in the upwardly displaced position of the piston 41, abuts against a setting screw 43 which closes the open end of the bore 31. A channel 44 leads from an upper portion of the bore 31 to a recess 45 which is provided in the sealing disk 20. A bore 46 extends from the recess 45 to the meshing region of the gears 16 and 17, and has a smaller diameter than the recess 45. Thus, the high-pressure fluid derived from the region of meshing of the gears 16 and 17 will act on the piston 41 in the downward direction as illustrated in FIG. 1. On the other hand, a compression spring 47 acts on the bolt-shaped lever 39 opposite to the action of the piston 41 thereon. A spring disk 48 is interposed between the bolt 9 and the compression spring 47. The arrangement and action of the piston 41 on the boltshaped lever 29 will be particularly evident from FIG. 2. The direction in which the piston 41 acts on the bolt 29 substantially coincides with the longitudinal direction of the separating body 34.

Having so discussed the construction of the machine of the present invention ready to be used as a pump, the operation of such pump will now be discussed in some detail.

Under these circumstances, that is, when the machine of the present invention is used as a pump, the spur gear 16 is caused to rotate in the clockwise direction, as a result of which fluid is drawn into the suction space 22 through the channel 23 of the housing and the interstices between the teeth of the spur gear 16 and those of the internal gear 17 become filled with the fluid. The fluid which is advanced by the action of the gears 16 and 17 along the separating body 34 is pressurized in the region of the meshing of the teeth of the gears 16 and 17, and is then supplied through the channel 24 of the housing 10 from the meshing region of the gears 16 and 17 to the above-mentioned non-illustrated user.

The pressure of the fluid which is encountered at the high-pressure zone of the machine is transmitted through the channel 44 into the upper part of the bore 31 so that this pressurized fluid will act on the piston 41. The piston 41, in turn, acts on the bolt-shaped lever 29 so that the barrel-shaped portion 32 subjects the separating body 34 to a force which is oriented approximately in the circumferential direction or direction of rotation and which presses the separating body 34 against the crests of the spur gear 16 and those of the internal gear 17. The spring 48 acts contrary to the force of the piston 41. Thus, the force of the spring 48 lifts the separating body 34 out of the interstice between the spur gear 16 and the internal gear 17 to such an extent as permitted by the abutment of the portion 42 of the piston 41 against the screw 53. The maximum radial play between the separating body 44 and the teeth of the gears 16 and 17 during the low-pressure operation is determined by the presence of washers 43" which are arranged below the head 43' of the setting screw 43.

In order that the separating body 34 is not drawn by the frictional forces between the gears 16 and 17 and the separating body 34 too deep into the interstice between the gears 16 and 17 when the machine is operated at no pressure or low pressure, the separating body 34 is positively connected with the bolt-shaped lever 29 such as, for instance, by a strap 40.

The depressions 35 and 36 in the sickle-shaped separating body have the following purpose: by means of these depressions 35 and 36, it is achieved that that fluid which is needed to pre-pressurize the volume of the fluid present in the interstices between the teeth, flows into the interstices between the teeth over the narrow projections 37, 38 in the separating body 34, at least predominantly, rather than over the crests of the teeth. When the width of the projections 37 and 38 and the shape of the depressions 35 and 36, as considered in the direction of rotation, are properly selected, there is obtained a constant, uniform and pulsation-free increase in the pressure in the respective interstice which advances toward the meshing region of the gears 16 and 17. In addition thereto, the following is also obtained. A disadvantage of conventional internal-gear pumps equipped with a stationary or a displaceable separating body and with axially adjustable sealing plates 20, 21 resides in the fact that the side surfaces of the gears 16 and 17 and the contact surfaces of the sealing plates 20 and 21 are subjected to wear during the operation of the machine, but the side surfaces of the separating body 34 are not. The result of this is that, with the passage of time, the pump will develop larger and larger leakages. This is attributable to the fact that the separating body 34 which has not been worn out prevents the sealing plates 20 and 21 from adjusting their positions so as to contact the axial sides of the gears 16 and 17 which have been worn out. On the other hand, as a result of the fact that, in the machine according to the present invention, a substantial amount of prepressurized fluid flows sidewise into the interstices between the teeth of the gears 16 and 17 over the relatively narrow projections 37 and 38, any impurities which usually are present in the fluid will wear out the relatively narrow sealing projections 37 and 38 to approximately the same extent of wear as encountered at the above-mentioned lateral surfaces of the gears 16 and 17 which are juxtaposed and in contact with the contact surfaces of the sealing plates 20 and 21. As a result of this, the sealing plates 20 and 21 can automatically adjust their positions so as to achieve the best sealing effect possible.

The width of the sealing projections 37 and 38 is so selected as considered in the direction of rotation of the gears 16 and 17 that the calculated flow through the gap between the sealing projection 37 or 38 and the sealing plate 20 or 21 results in a pressure increase in the interstices of the two gears which is substantially linear.

Figure 3:
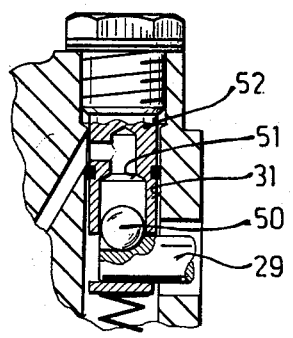
FIG. 3 is a sectional view of a modification of FIG. 1.
Figure 4A:
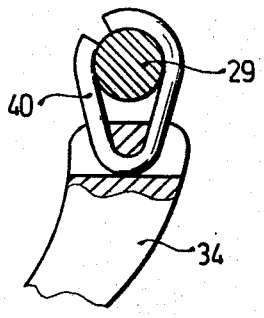
FIG. 4*a* is a partly sectioned fragmentary end view of another detail of FIG. 1.
Figure 4B:
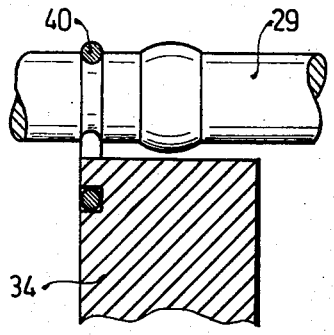
FIG. 4*b* is a sectioned side view of the detail of FIG. 4*a*.

FIG. 3 illustrates that the piston which acts on the bolt-shaped lever 29 may be a spherical piston 50 which is displaceably received in a central bore 51 of a cylinder body 52. The cylinder body 52, in turn, is slidably received in the bore 31. In this embodiment, the abutment of the bolt-shaped lever 29 against the cylinder body 52 will limit the extent of movement of the lever 29 to the desired extent.

As can be ascertained from the above description, the separating body 34 is guided in the interior of the machine only by the gears 16 and 17 and the sealing plates 20 and 21 in addition, of course, to its connection to the bolt-shaped lever 29. This relative freedom of movement of the sickle-shaped separating body 34 in the space available to it for its displacement permits the separating body 34 to always assume the most advantageous position relative to the gears 16 and 17 and to the sealing plates 20 and 21.

It will be understood that each of the elements described above, or two or more together, may also find a useful application in other types of constructions differing from the types described above.

While the invention has been illustrated and described as embodied in an internal-gear fluid-displacement machine used as a pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An internal-gear fluid-displacement machine comprising, in combination, a housing having an internal chamber; an internal gear in said chamber; a spur gear located in said chamber and meshing with said internal gear at a meshing region which constitutes a high-pressure zone of the machine during operation, said gears bounding with each other an interspace which constitutes a low-pressure zone of the machine, and a separating region which narrows from said interspace toward said meshing region; an elongated separating body which fills said separating region thus separating said low-pressure and high-pressure zones from one another; an actuating element connected to said separating body for joint displacement substantially longitudinally of the latter, said actuating element being a lever having one end mounted on said housing for pivoting and another end; and means for subjecting said actuating element to a force which acts substantially longitudinally of said separating body and has a magnitude which depends on the pressure of a fluid present at said high-pressure zone, said subjecting means including a bore in said housing, a piston mounted in said bore and having one end face bounding a pressure space in said bore and another end face facing said other end of said lever, and means for admitting the fluid from said high-pressure zone into said pressure space to act on said piston and press the same against said other end of said lever.

2. A combination as defined in claim 1; wherein said gears have respective axial faces; further comprising sealing plates in contact with said axial faces of said gears; and wherein said sealing plates guide said separating body for said displacement.

3. A combination as defined in claim 1, wherein said subjecting means further includes a spring acting on said piston opposite to the action of the fluid thereon.

4. A combination as defined in claim 1, wherein said piston has a spherical configuration at least at a region thereof which contacts said lever.

5. A combination as defined in claim 1, and further comprising means for mounting said gear on said housing for rotation, including coaxial bores in said housing for mounting said spur gear, and a bearing bowl for supporting said internal gear.

6. A combination as defined in claim 1, and further comprising means for determining the play between said separating body and said gears, including means for limiting the extent of displacement of said piston.

7. A combination as defined in claim 6, wherein said limiting means includes an abutment rigid with said housing.

8. A combination as defined in claim 1, wherein said separating body has two axial sides, and a narrow sealing projection at each of said axial sides bounding a depression which substantially conforms in shape to the respective axial side.

9. A combination as defined in claim 8, wherein said sealing projection converges toward said meshing region.

10. An internal-gear fluid-displacement machine comprising, in combination, a housing having an internal chamber; an internal gear in said chamber; a spur gear located in said chamber and meshing with said internal gear at a meshing region which constitutes a high-pressure zone of the machine during operation, said gears bounding with each other an interspace which constitutes a low-pressure zone of the machine, and a separating region which narrows from said interspace toward said meshing region; an elongated separating body which fills said separating region thus separating said low-pressure and high-pressure zones from one another; an actuating element connected to said separating body for joint displacement substantially longitudinally of the latter, said actuating element being a lever having one end mounted on said housing for pivoting and another end; means for subjecting said actuating element to a force which acts substantially longitudinally of said separating body and has a magnitude which depends on the pressure of a fluid present at said high-pressure zone, said subjecting means including a bore in said housing, a piston mounted in said bore and having one end face bounding a pressure space in said bore and another end face facing said other end of said lever, and means for admitting the fluid from said high-pressure zone into said pressure space to act on said piston and press the same against said other end of said lever; and means for determining the play between said separating body and said gears, including means for limiting the extent of displacement of said piston, said limiting means including an abutment rigid with said housing, said abutment being a setting screw extending to a predetermined extent into said bore and having an abutment surface against which said piston abuts at one end of its stroke.

11. An internal-gear fluid-displacement machine comprising, in combination, a housing having an internal chamber and an opening; an internal gear in said chamber; a spur gear located in said chamber and meshing with said internal gear at a meshing region which constitutes a high-pressure zone of the machine during operation, said gears bounding with each other an interspace which constitutes a low-pressure zone of the machine, and a separating region which narrows from said interspace toward said meshing region; an elongated separating body which fills said separating region thus separating said low-pressure and high-pressure zones from one another; an actuating element connected to said separating body for joint displacement substantially longitudinally of the latter, said actuating element being a lever having one end mounted on said housing for pivoting and another end; means for subjecting said actuating element to a force which acts substantially longitudinally of said separating body and has a magnitude which depends on the pressure of a fluid present at said high-pressure zone, said subjecting means including a bore in said housing, a piston mounted in said bore and having one end face bounding a pressure space in said bore and another end face facing said other end of said lever, and means for admitting the fluid from said high-pressure zone into said pressure space to act on said piston and press the same against said other end of said lever; means for determining the play between said separating body and said gears, including means for limiting the extent of displacement of said piston, said limiting means including an abutment rigid with said housing; and a cylinder body detachably mounted in said opening of said housing and having said bore for said piston, said cylinder body having an abutment surface which constitutes said abutment and against which said lever abuts at one extreme of its displacement.

12. An internal-gear fluid-displacement machine comprising, in combination, a housing having an internal chamber; an internal gear in said chamber; a spur gear located in said chamber and meshing with said internal gear at a meshing region which constitutes a high-pressure zone of the machine during operation, said gears bounding with each other an interspace which constitutes a low-pressure zone of the machine, and a separating region which narrows from said interspace toward said meshing region; an elongated separating body which fills said separating region thus separating said low-pressure and high-pressure zones, said separating body having a contact surface which faces said interspace; an actuating element connected to said separating body for joint displacement substantially longitudinally of the latter, said actuating element being a lever which has one end mounted on said housing for pivoting and another end, said lever extending into said interspace and abutting said contact surface of said separating body; and means for subjecting said actuating element to a force which acts substantially longitudinally of said separating body and has a magnitude which depends on the pressure of a fluid present at said high-pressure zone, said subjecting means including a bore in said housing, a piston mounted in said bore and having one end face bounding a pressure space in said bore and another end face facing said other end of said lever, and means for admitting the fluid from said high-pressure zone into said pressure space to act on said piston and press the same against said other end of said lever.

13. A combination as defined in claim 12, and further comprising means for connecting said lever to said separating body, including a strap.

* * * * *